US011189151B2

(12) United States Patent
Artzt et al.

(10) Patent No.: US 11,189,151 B2
(45) Date of Patent: Nov. 30, 2021

(54) MONITORING SYSTEM FOR A WATER ENVIRONMENT

(71) Applicant: Punch Technologies, Inc., Charlotte, NC (US)

(72) Inventors: Gregory Brian Artzt, Weddington, NC (US); Carole Tobias, Lewisville, NC (US); Charles Andrew Prisk, Clemmons, NC (US)

(73) Assignee: Punch Technologies, Inc., Charlotte, NC (US)

( * ) Notice: Subject to any disclaimer, the term of this patent is extended or adjusted under 35 U.S.C. 154(b) by 0 days.

(21) Appl. No.: 16/811,322

(22) Filed: Mar. 6, 2020

(65) Prior Publication Data

US 2020/0286359 A1 Sep. 10, 2020

Related U.S. Application Data

(60) Provisional application No. 62/815,586, filed on Mar. 8, 2019.

(51) Int. Cl.
*G08B 21/08* (2006.01)

(52) U.S. Cl.
CPC ..... *G08B 21/088* (2013.01)

(58) Field of Classification Search
CPC ..... G08B 21/08; G08B 21/088
See application file for complete search history.

(56) References Cited

U.S. PATENT DOCUMENTS

2018/0040223 A1* 2/2018 Bodi ..... G08B 21/086
2019/0333356 A1* 10/2019 Boyle ..... G08B 21/088

OTHER PUBLICATIONS

RJE Technologies, Inc., "Safety Turtle 2.0 Pool Alarm", Retrieved from the internet: URL: https://www.safetyturtle.com/products/ [retrieved on Feb. 12, 2020]; pp. 1-3.
RJE Technologies, Inc., "Safety Turtle 2.0 Pool Alarm Child Kit", Retrieved from the internet: URL: https://www.safetyturtle.com/safety-turtle-2-0-pool-alarm-child-kit/ [retrieved on Jan. 30, 2019]; pp. 1-4.

* cited by examiner

*Primary Examiner* — Quan-Zhen Wang
*Assistant Examiner* — Rajsheed O Black-Childress
(74) *Attorney, Agent, or Firm* — Coats & Bennett, PLLC

(57) ABSTRACT

A monitoring system with one or more wearable devices and an alert station. The wearable device comprises sensors to detect conditions of the wearer and to transmit signals to the alert station. The alert station is configured to declare an emergency upon the occurrence of various events.

16 Claims, 11 Drawing Sheets

MONITORING SYSTEM FOR A WATER ENVIRONMENT

RELATED APPLICATIONS

The present application claims the benefit of U.S. Provisional Application No. 62/815,586 filed on Mar. 8, 2019, and which is hereby incorporated by reference in its entirety.

BACKGROUND

Monitoring systems are needed to protect users against potential dangers, such as from drowning at a water environment. An issue with existing monitoring systems is the inability to monitor users in the various different situations that could occur.

SUMMARY

One aspect is directed to a system to monitor a user at a water environment. The system comprises a wearable device configured to be worn by the user with the wearable device comprising an input button, a first sensor that detects water, and a second sensor that detects one or more characteristics of a fall. An alert station is configured to receive signals from the wearable device and to declare an emergency in each of the following situations: the alert station receives a signal from the wearable device that the input button has been activated; the alert station receives a first signal from the wearable device that the first sensor detects the water; and the alert station receives a second signal from the wearable device that the second sensor has detected one or more characteristics of a fall and the alert station does not receive a heartbeat signal or less than a predetermined number of the heartbeat signals from the wearable device within a predetermined period of time after receiving the second signal.

In another aspect, the wearable device comprises an exterior housing that extends around the second sensor and with the input button being exposed on the exterior housing.

In another aspect, the alert station comprises a speaker to emit sound when an emergency is declared.

In another aspect, the wearable device is configured to transmit the heartbeat signals to the alert station at regular time intervals.

In another aspect, the wearable device is configured to transmit the signals to the alert station using LoRa signals.

In another aspect, the alert station is configured to determine that there is no emergency upon receiving the heartbeat signal within the predetermined period of time after receiving the second signal from the wearable device.

In another aspect, the wearable device is a first wearable device and further comprising a second wearable device that comprises an input button, a first sensor to detect that the wearable device is in the water, and a second sensor that detects that the user has fallen.

In another aspect, the wearable device further comprises a control circuit configured to determine that the wearable device is in water based on readings from the first sensor and configured to determine that the user has fallen based on readings from the second sensor.

In another aspect, the alert station further comprises a control circuit configured to determine that the wearable device is in water based on readings from the first sensor and configured to determine that the user has fallen based on readings from the second sensor.

One aspect is directed to a system to monitor a user at a water environment. The system comprises a wearable device configured to be worn by the user with the wearable device comprising a housing that extends around and forms an interior space, an accelerometer positioned in the interior space, a water sensor attached to the housing, a wearable device control circuit positioned in the interior space, and a wearable device communication circuit configured to transmit signals. An alert station is configured to be positioned in proximity to the water environment. The alert station comprises a communications circuit configured to receive the signals from the wearable device, and an alert station control circuit configured to declare an emergency that the user is in danger in each of the following situations: the user is in the water based on signals received from the wearable device indicating that the water sensor detects the water; and the user has fallen based on signals received from the wearable device indicating that the accelerometer has detected a fall and that a heartbeat signal has not been received from the wearable device or a limited number of the heartbeat signals have been received within a predetermined period of time after receiving the signals indicating the fall.

In another aspect, a wearable device control circuit is positioned in the interior space and configured to determine that the user has fallen based on signals from the accelerometer and to determine that the user is in the water based on signals from the water sensor.

In another aspect, the alert station control circuit is configured to determine that the user has fallen based on signals from the accelerometer and to determine that the user is in the water based on signals from the water sensor.

In another aspect, the communications circuit of the wearable device is configured to transmit signals to the alert station using LoRa signals.

In another aspect, an input button is on the housing and wherein the alert station control circuit is configured to declare an emergency that the user is in danger upon receiving a signal from the wearable device that the input button has been activated.

One aspect is directed to a method of monitoring a user that is wearing a wearable device around water. The method comprises: receiving heartbeat signals at regular intervals from the wearable device indicating that the wearable device is within range; receiving a first signal from the wearable device indicating that the user has activated an input button; receiving a second signal from the wearable device indicating that the wearable device is in the water; receiving a third signal from the wearable device indicating that the user has fallen; and declaring an emergency for each of first, second, and third situations with the first situation comprising receiving the first signal, the second situation comprising receiving the second signal, and the third situation comprising receiving the third signal and not receiving a heartbeat signal or receiving a limited number of the heartbeat signals within a predetermined time after receiving the third signal.

In another aspect, the method further comprises receiving each of the heartbeat signals, the first signal, the second signal, and the third signal within a LoRa frequency range.

The various aspects of the various embodiments may be used alone or in any combination, as is desired.

DETAILED DESCRIPTION

Figure 1:
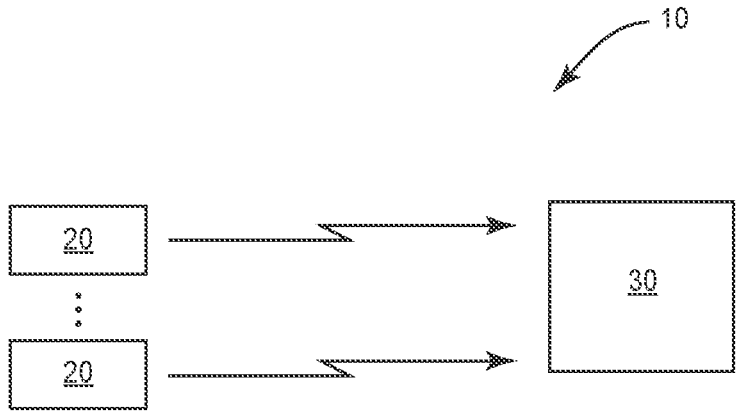
FIG. 1 is a schematic diagram of a monitoring system.

The present application is directed to a monitoring system 10. As illustrated in FIG. 1, the system 10 includes one or more wearable devices 20 that communicate with an alert station 30. Each wearable device 20 is configured to be worn by a person (referred to as a wearer) and communicate information to the alert station 30. The alert station 30 is configured to identify an emergency situation with the wearer. The alert station 30 declares an emergency which can include notifying one or more persons at the water environment and/or remote personnel. The system 10 can be used in a variety of different contexts, and has particular applicability to swimmers at a water environment, such as but not limited to a swimming pool, water park, lake, beach, etc. In one example, the system 10 is used to monitor lifeguards to determine when they enter the water to assist a person, or if the lifeguards themselves are in need of aid.

Figure 2:
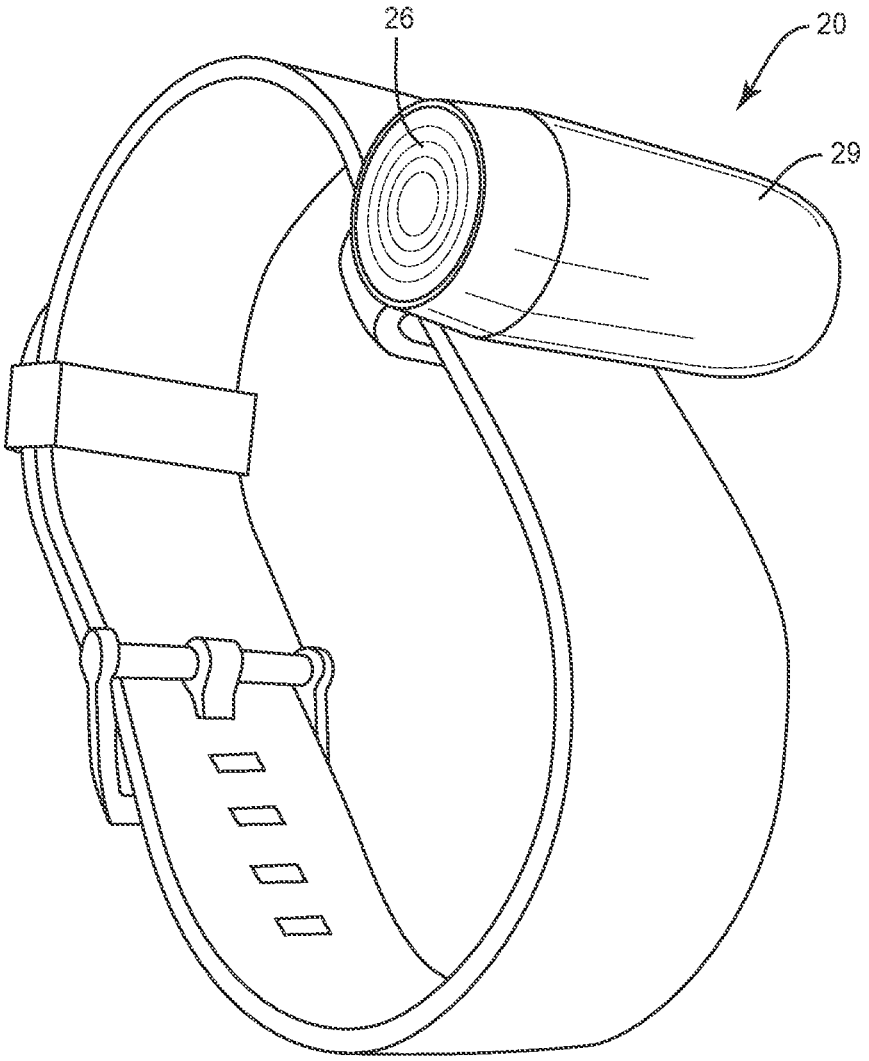
FIG. 2 is a perspective view of a wearable device mounted to a band.

FIG. 2 illustrates one example of a wearable device 20. The wearable device 20 is configured to be attached to a member 100, such as wrist band, lanyard, or necklace to be worn by the wearer. The wearable device 20 includes a rigid outer housing 29 that extends around and forms a waterproof interior space to house and protect the electrical components. An input button 26 is exposed on the exterior of the housing 29. The input button 26 can be recessed within an opening in the housing 29. This positioning prevents and/or reduces inadvertent activation.

Figure 3:
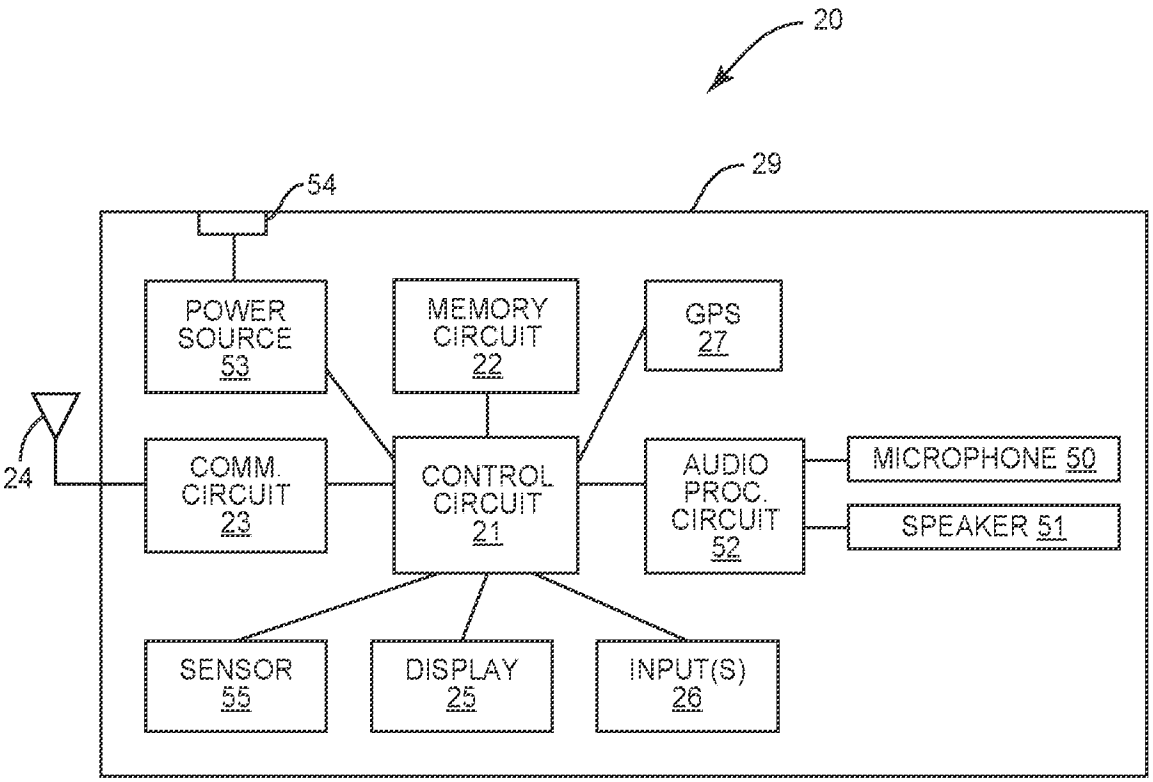
FIG. 3 is a schematic diagram of a wearable device.

FIG. 3 illustrates a block diagram of a wearable device 20 and the various electrical components. The wearable device 20 includes a control circuit 21 that controls the overall functioning of the device 20. The control circuit 21 can include one or more microprocessors, microcontrollers, Application Specific Integrated Circuits (ASICs), or other programmable devices. The control circuit 21 can be configured to execute program code stored within the device 20 or accessible by the device, to control the various components and their functions. For example, the program code can be stored in memory circuit 22, or can be downloaded from the alert station 30 or a remote server 60 (see FIG. 6).

Memory circuit 22 can include one or several types of non-transitory memory, including, for example, read-only memory, flash memory, magnetic or optical storage devices, or the like. In some embodiments, one or more physical memory units can be shared by the various components. Other embodiments can have physically separate memories for one or more of the different components.

A communications circuit 23 provides wireless access to the alert station 30. The communications circuit 23 can also provide for communicating with other remote sources, such as a wireless communication network with connectivity to a wide-area network. The communication circuit 23 can include one or more radio frequency transmitters and receivers for transmitting and receiving signals through an antenna 24. In one example, the communication circuit 23 includes four separate radios that are each programmed to different kinds of signals. The signals can include but are not limited to signals at different wavelengths, different lengths, burst emergencies, complex heartbeats, accelerometer activations, and water activations. The communications circuit 23 can be further configured to send and receive information through various formats, such as but not limited to SMS text messages and files.

The communications circuit 23 can be configured to communicate with the alert station 30 through LoRa which uses sub-gigahertz radio frequency bands that allow for long range, low frequency communication. Frequencies include but are not limited to 433 MHz, 868 MHz, 915 MHY, and 923 MHz. In one example, the communications circuit 23 operates in the 902-928 MHz. LoRa can be effective in communication when the wearable device 20 is submersed in water. In one example, the communications circuit 23 operates using LoRaWAN. The communications circuit 23 can also be configured to provide for connectivity through other communication channels, including but not limited to near field communication (NFC), Bluetooth, and WiFi. Another design operates within a frequency band of 863-870 MHz. In another example, the communications circuit uses a communications through the cellular network.

The communications circuit 23 can also include a receiver to receive signals from a remote entity. This can include signals from the alert station 30 and/or the remote server 60 and/or emergency personnel 70.

In one embodiment, a display 25 provides viewable information for the wearer. The display 25 can comprise any known electronic display, such as a liquid crystal display. The display 25 can also provide for a visual alert in the event of an alarm or other condition such as a low battery, or being out of range from the alert station 30. Inputs 26 can include one or more control buttons that are exposed on the exterior of the housing 29. The inputs 26 provide for the wearer to enter various commands and make menu selections for menus presented on the display 25. One input 26 is the alert input button that is depressed by the wearer in the event of an emergency. The alert button activates an alarm that causes an audible sound to be emitted through a speaker 51. The alert button can also cause a visual alert using one or more lights. This input can also result in a signal being transmitted to the alert station 30 and/or a remote server 60 and cause an emergency situation to occur. The alarm input 26 can also be configured to deactivate the alarm, such as by being depressed and held for a period of time by the wearer.

A global positioning system (GPS) component 27 can be configured to receive coordinate information from various sources (e.g., satellites, base stations, alert station 30) to determine a geographic position of the wearable device 20.

In one example, the location of the wearable device is determined with Bluetooth low energy (BLE) or LoRa with indoor location triangulation using beacons placed throughout a facility. Proximity detection of the wearable device 20 allows it to know and report its position to the alert station 30. Indoor triangulation can also be done with cellular communications in an environment that has a distributed antenna system (DAS) or other cellular infrastructure, as well as Wifi using proximity to access points.

In one embodiment, the wearable device 20 further includes a microphone 50, speaker 51, and an audio processing circuit 39. The audio processing circuit 39 is configured to provide audio processing functionality for processing voice data for communications through the speaker 51 and microphone 50.

In one example, the control circuit 21 includes a chip (such as an ESP 32) that supports a SIP client for making VOIP calls. The control circuit 21 using the audio processing circuit 52 and the communication circuit 23 allows for direct 911+ calling to any PSAP where simultaneously other local responders or connections can be plugged into the call for support.

A power source 53 provides power to the electrical components. The power source 53 can include a rechargable battery and includes a port 54 for engaging with a power cord for recharging. In another embodiment, the power source 53 is a rechargeable battery configured to be recharged through inductive charging. Various other types of power sources 53 can also be included in the wearable device 20.

One or more sensors 55 can be included with the wearable device 20. One or more sensors 55 can be configured to detect when the wearable device 20 is exposed to water, including when submerged in water. In the event that the one or more sensors 55 detect water, the device 20 automatically activates the alarm. Thus, the device 20 can be activated by either a manual activation through the input button 26 or automatically by a sensor 55.

In one example, the wearable device 20 includes two or more sensors 55 each configured to detect water. The sensors 55 are positioned at different locations on the wearable device 20. In one specific example, a pair of sensors 55 are spaced apart on opposite sides of the housing 29. The control circuit 21 is configured to receive signals from the sensors 55 and requires the sensors 55 to be activated by water simultaneously in order to activate to prove that the wearable device 20 is submerged in water and not simply being splashed which would be a false alarm. In one specific embodiment with two sensors 55, each of the sensors 55 is activated in order for the control circuit 21 to determine the wearable device 20 is submerged in water.

One or more sensors 55 can include accelerometers that detect the orientation of the device 20 to include if the wearer has fallen. In one example, the one or more orientation sensors 55 measure the instantaneous orientation of the device 20. The orientation is an angle of slope, elevation, or depression of the device 20 with respect to gravity in one or more axes. In another example, the one or more sensors 55 detect an acceleration of the device 20. In another example, one or more sensors 55 sense a height of the wearable device 20.

The control circuit 21 is configured to receive the signals from the one or more sensors 55 and determine that the wearer has fallen. In one example, a fall is determined when the orientation is at a predetermined level for a predetermined period of time. In another example, the control circuit 21 determines that the wearer has fallen when the acceleration of the device 20 is about zero. In another example, the control circuit 21 determines a fall when the height changes a predetermined amount over a predetermined time period. For example, the height of the wearable device 20 changes 5 feet in under one second.

The wearable device 20 can periodically transmit a signal to the alert station 30. This heartbeat signal can be transmitted at a regular frequency (e.g., every 0.5 seconds). The heartbeat signal indicates to the alert station 30 that the device 20 is still operating and within range. In one example, the heartbeat signal includes the energy level of the power source 53. In the event the alert station 30 does not receive the heartbeat signal within a predetermined period of time, the alert station 30 can signal that there is an issue. This can include one or more of sending a signal to the wearable device 20 about the issue, sounding an audible or visible alarm at the alert station 30, or signaling the remote server 60 to contact an individual associated with the wearable device 20 notifying them of the issue.

In one example, when the accelerometer sensor 55 detects a fall, the wearable device 20 reports this immediately to the alert station 30. This signaling occur prior to the normal periodicity of the heartbeat. This timing provides for the signal to be effectively transmitted from the wearable device 20 to the alert station 30 prior to the wearer potentially being in a situation that is not able to effectively transmit, such as after being submerged in water. After transmitting the signal, the control circuit 21 increases the frequency of the heartbeat signal that is transmitted to the alert station 30. This ensures that the wearer that was potentially falling is not deep in water and therefore the wearable device 20 is having trouble reporting the heartbeat through water.

Figure 4:
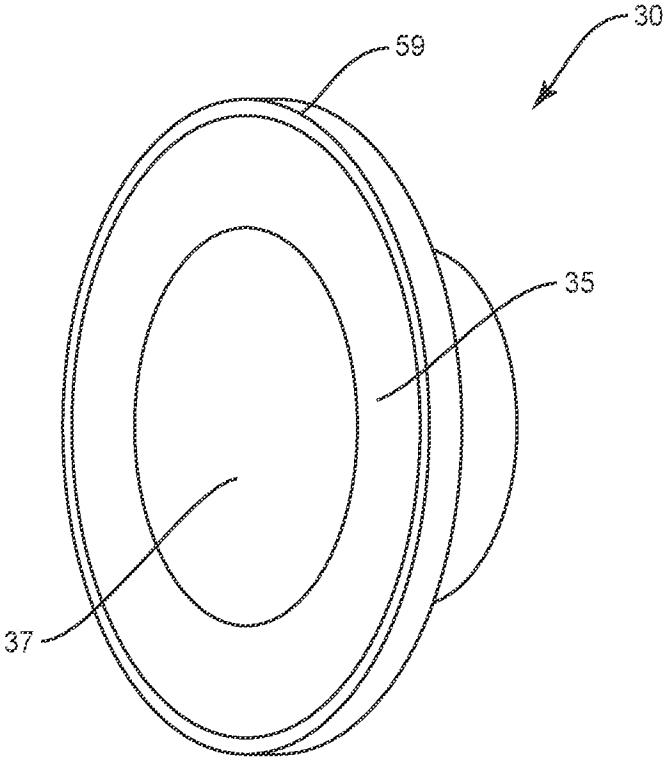
FIG. 4 is a perspective view of an alert station.

The alert station 30 is configured to communicate with the one or more wearable devices 20. The alert station 30 is configured to be positioned in proximity to the wearers. In one embodiment, this can include with the vicinity of the body of water. As illustrated in FIG. 4, the alert station 30 can include an outer housing 59 to protect the interior electrical components. The housing 59 can also be waterproof to prevent the ingress of water. One or more sections of the housing 59 can be transparent for a light within the interior space to be visible during an alarm. A speaker 37 provides for transmitting an alarm during an emergency event. One or more input buttons 35 are positioned on the exterior of the housing 59 for a user to push to signal an alarm.

Figure 5:
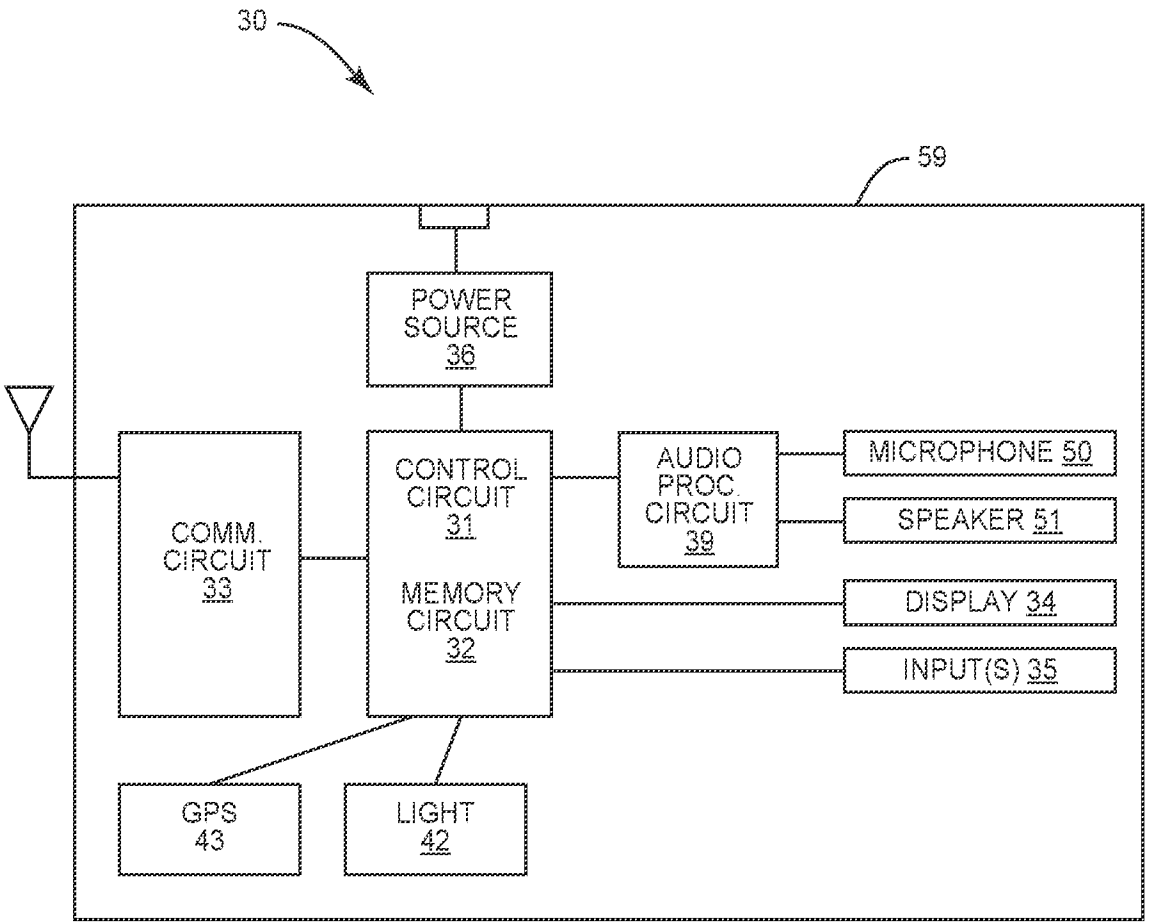
FIG. 5 is a schematic diagram of an alert station.

As illustrated in FIG. 5, the alert station 30 includes a control circuit 31, memory circuit 32, and a communication circuit 33 positioned within the housing 59. The control circuit 31 controls the overall operation according to program instructions stored in the memory circuit 32. The control circuit 31 can comprise one or more circuits, microcontrollers, microprocessors, hardware, or a combination thereof. Memory circuit 32 includes a non-transitory computer readable storage medium storing program instructions, such as a computer program product, that configures the control circuit 31 to implement one or more of the techniques discussed herein. Memory circuit 32 can include various memory devices such as, for example, read-only memory, and flash memory. Memory circuit 32 can be incorporated with the control circuit 31 as illustrated in FIG. 5, or the two can be separate. Alternatively, the control circuit 31 can omit the memory circuit 32, e.g., according to at least some embodiments in which the control circuit 31 is dedicated and non-programmable.

The communications circuit 33 enables communication between the control circuit 31 and one or more other entities, such as the wearable devices 20 and/or one or more remote sources over communication networks. In the exemplary embodiment, the communications circuit 33 can include one or more interfaces. Interfaces can provide for communications via a variety of networks including a mobile communication network (e.g., a WCDMA, LTE, or WiMAX network), Ethernet, local area network, e.g., via a wireless access point such as one to operate according to the 802.11 family of standards which is commonly known as a WiFi interface, a personal area network (PAN) interface 76 such as a Bluetooth interface, and a Near Field Communication (NFC) interface 77.

The alert station 30 and the wearable devices 20 can transmit information using one or more of a variety of wireless communication protocols. One example includes LoRa which is effective for communications in a water environment, such as if the wearable device 20 is submersed in water. Other examples include, but are not limited to Institute of Electrical and Electronics Engineers (IEEE) 802.11 Wireless Fidelity (WiFi), Radio Frequency Identification (RFID), and Near Field Communication (NFC).

The alert station 30 can include a display 34 to display messages to the user. One or more inputs 35 (e.g., keypad, touchpad) can be positioned on the housing 59 for the user to input various information. One or more lights 42 can be activated and are visible through the transparent section of the housing 59.

The alert station 30 can include a microphone 38, speaker 37, and an audio processing circuit 39. The audio processing circuit 39 is configured to provide audio processing functionality for processing voice data for communications through the speaker 37 and microphone 38. In one example, the control circuit 31 includes a chip (such as an ESP 32) that supports a SIP client for making VOIP calls. The control circuit 31 using the audio processing circuit 39 and the communication circuit 33 allows for direct 911+ calling to any PSAP where simultaneously other local responders or connections can be plugged into the call for support.

A GPS unit 43 can also be included to determine the geographic location of the alert station 30. A clock can also be included to monitor the time to be included in emergency signaling to a remote entity.

A power source 36 can provide power to the control circuit 31. The power source 36 can include various configurations, including but not limited to batteries. The alert station 30 can additionally or alternatively provide a hardwire connection to an external power source (e.g., electrical power from the building or over the ethernet).

In one example, the control circuit 31 receives signals from the wearable device 20 indicating the status of the wearable device 20. This can include one or more of the sensing of water and the sensing that the user has fallen. That is, the control circuit 21 of the wearable device 20 determines that one of these events has occurred and signals the alert station 30. In another example, the control circuit 31 receives the raw sensor data from the wearable device 20 and the control circuit 31 determines whether any of these events has occurred. In another example, both control circuits 21, 31 determine the occurrence of any of these events.

Figure 6:
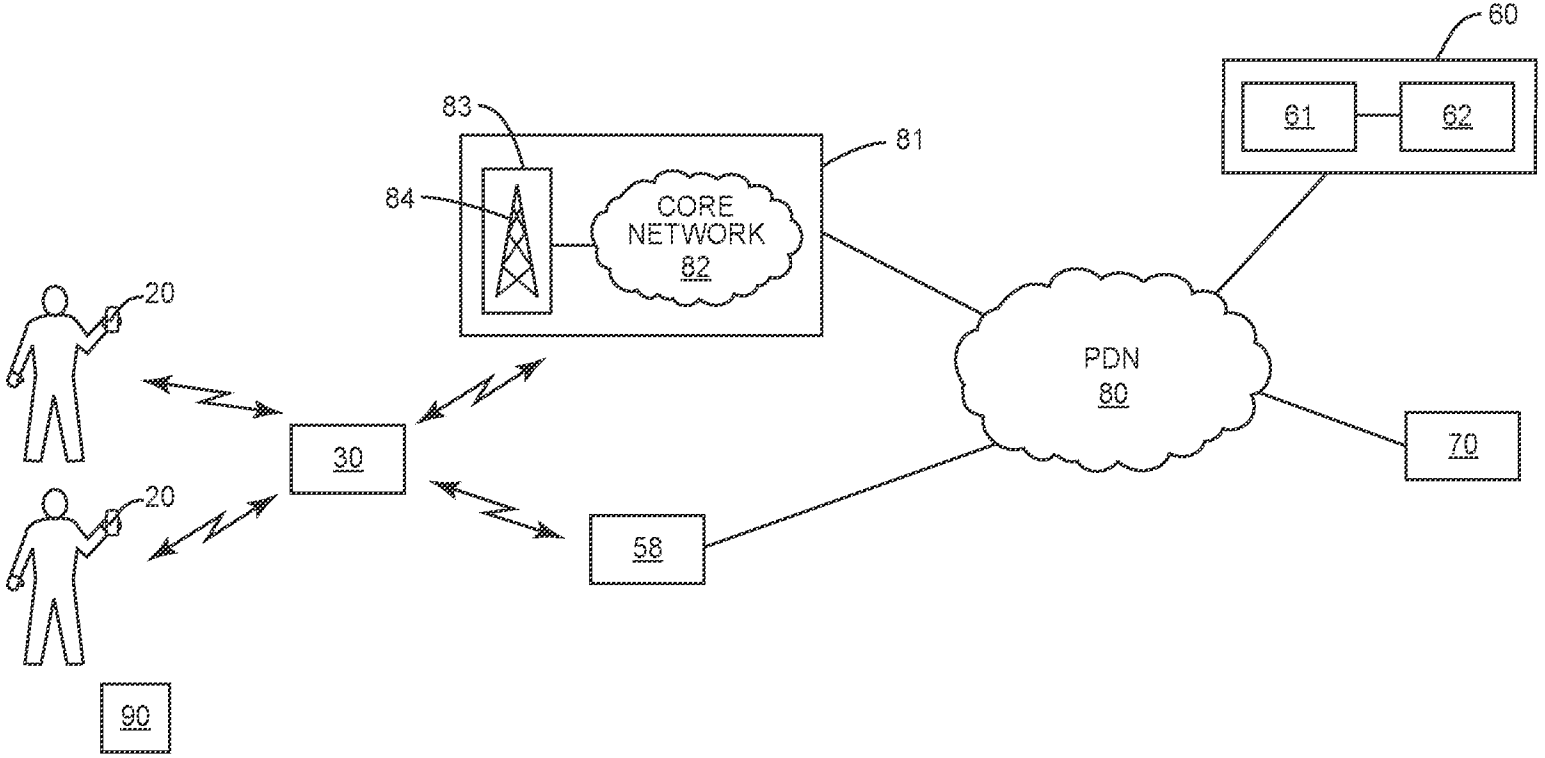
FIG. 6 is a schematic diagram of a wireless communication network.

FIG. 6 illustrates a wireless communication network in which the wearable devices 20 can communicate with the alert station 30 and with remote entities, including a remote server 60 and emergency personnel 70. The network includes a packet data network (PDN) 80 that can comprise a public network such as the Internet, a private network, or both. The mobile communication network (MCN) 81 includes a core network 82 and a radio access network (RAN) 83 including one or more base stations 84. The MCN 81 can be a conventional cellular network operating according to any communication standards now known or later developed. For example, the MCN 81 can include a Wideband Code Division Multiple Access (WCDMA) network, a Long Term Evolution (LTE) network, or WiMAX network. The MCN 81 is further configured to access the PDN 80.

The alert station 30 can also communicate with a wireless access point 58 to access the PDN 80. The alert station 30 can also be connected to a nearby device (not shown) through a wired interface, such as a RS 232, USB or FIREWARE interface. Such a device would be configured to access the PDN 80.

The alert station 30 is configured to communicate through the PDN 80 to a server 60. The server 60 can be configured to provide a web interface 61 for users of the system to access information. A database 62 can also be associated to store the wearer information or information about the alert station 30 (e.g., location, registered users). The server 60 includes one or more processing circuits that can include one or more microprocessors, microcontrollers, Application Specific Integrated Circuits (ASICs), or the like, configured with appropriate software and/or firmware. A computer readable storage medium stores data and computer readable program code that configures the processing circuit to implement the techniques described above. Memory circuit is a non-transitory computer readable medium, and may include various memory devices such as random access memory, read-only memory, and flash memory. A communication interface connects the server 60 to the PDN 80, and may be configured to communicate with the PDN 80 according to one or more 802.11 standards. The communication interface may support a wired connection (e.g., Ethernet), a wireless connection, or both. The database 62 is stored in a non-transitory computer readable storage medium (e.g., an electronic, magnetic, optical, electromagnetic, or semiconductor system-based storage device). The database 62 may be local or remote relative to the monitoring server 60. A clock may be associated with the processing circuit that measures the various timing requirements for specific events. The clock may be incorporated with the processing circuit, or may be a separate component independent from the processing circuit. The clock may be configured to measure the specific time during each day, as well as to measure the various time periods (i.e., days, weeks, months, years, etc.).

The users of the system 10 can be required to maintain an active account that includes their identification information, billing information, authentication information, and any special instructions regarding use of the system 10. The server 60 can provide a web interface for the user of the system 10 to initially open an account, and then also to monitor and control their account. The web interface can support a website through which the contents of the database 62 are accessible. In one or more embodiments the web interface provides browser-based access to the contents of the database 62. The user can login to the browser-based interface and access the pertinent medication usage information. Alternatively, the user can obtain information from the database 62 using one or more Application Programming Interfaces (APIs) through a desktop or mobile client, for example. Also, in one or more embodiments the web interface supports access to the database 62 using web services in addition to, or as an alternative to, the browser-based interface described above.

Emergency personnel 70, such as police, fire and rescue, etc. are further accessible through the network over the PDN 80. In the event of an alert condition, the emergency personnel 70 can be notified regarding the location and as much information about the event as possible. The emergency personnel can then respond as necessary.

Figure 7:
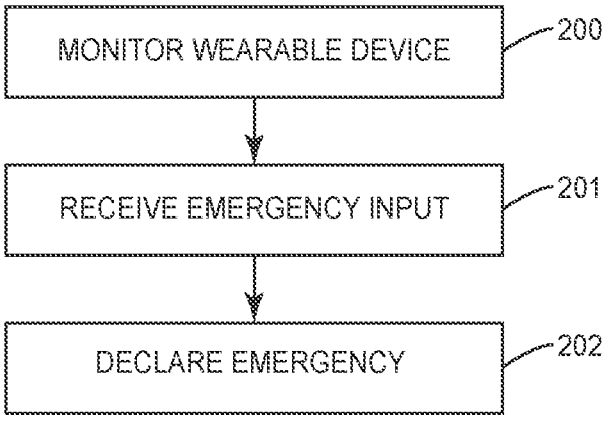
FIG. 7 is a flowchart diagram of a method of declaring an emergency.

An emergency situation can be signaled from the wearable device 20 in various manners. In one embodiment as illustrated in FIG. 7, the alert station 30 monitors the wearable device (block 200) and receives an emergency input caused by the wearer depressing the input button 26 (block 201). The alert station 30 declares an emergency upon receiving the signal (block 202).

Figure 8:
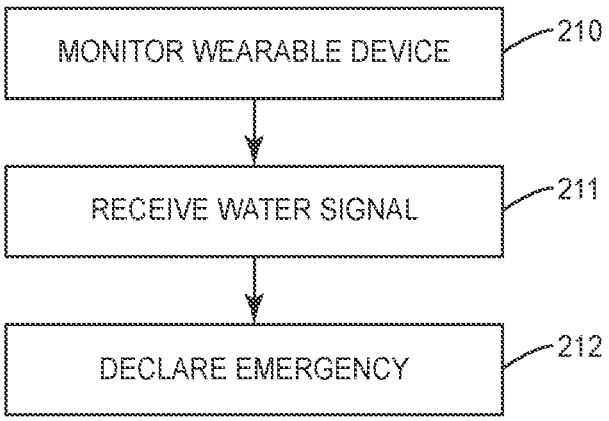
FIG. 8 is a flowchart diagram of a method of declaring an emergency.

FIG. 8 illustrates another situation in which the alert station 30 declares an emergency. The alert station 30 monitors the wearable device 20 (block 210) and receives an indication that the wearable device 20 is in water (block 211). In one example, this occurs when one or more sensors 55 in the wearable device 20 sense water. The control circuit 21 processes the data, determines that the wearable device 20 is in the water, and signals the alert station 30. Upon receiving the signal, the alert station declares an emergency (block 212). In one example, the control circuit 21 signals the alert station 30 upon initially determining the water. In another example, the control circuit 21 senses water for a predetermined period of time prior to signaling the alert station 30.

In a similar method, the alert station 30 receives the raw sensor data from the one or more sensors 55. The control circuit 31 at the alert station 30 processes the data and determines that the one or more sensors 55 are in water and then declares the emergency.

Figure 9:
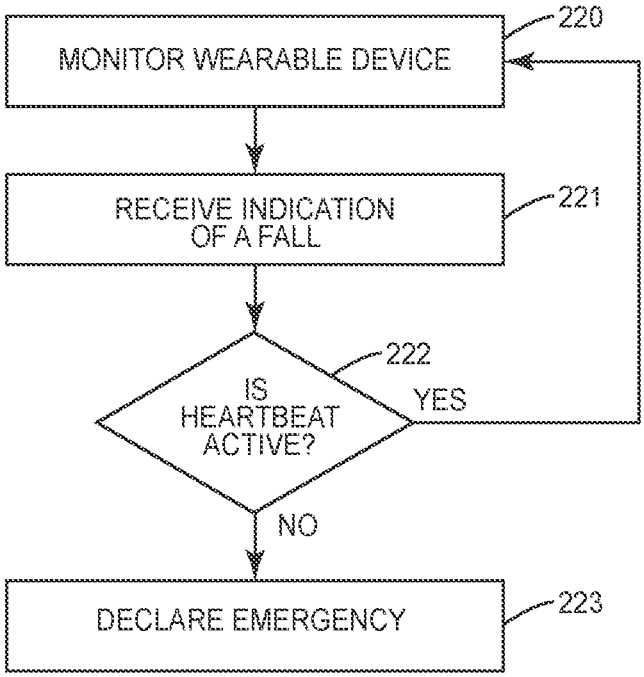
FIG. 9 is a flowchart diagram of a method of declaring an emergency.

FIG. 9 illustrates another method of detecting an emergency situation. The alert station 30 monitors the wearable device 20 (block 220). The alert station 30 receives an indication of a fall from the wearable device 20 (block 221). In examples, this occurs when the control circuit 21 senses a predetermined change in the angle of the accelerometer 55, a change in the acceleration of the wearable device 20, or when a change in height beyond a predetermined amount is detected. In other examples, the alert station 30 receives the raw sensor data and processes the information to determine that there has been a fall.

The alert station 30 then determines whether a heartbeat signal is received from the wearable device 20 within a predetermined time period of when the one or more sensors 55 detect a fall (block 222). If a heartbeat signal is received within the time period, the alert station 30 determines that there is no emergency and continues to monitor the wearable device. If no heartbeat signal is received within the time period, the alert station 30 declares an emergency (block 223). In one example, instead of determining that no heartbeat signals are received, the alert station receives a very limited number of heartbeat signals which are well below the expected number based on the frequency of heartbeat signals. When no heartbeat signal and/or limited heartbeat signals are received from the wearable device 20 after the indication of a fall, the alert station 30 assumes that the wearer has fallen into the water and the water is preventing a signal from the wearable device 20 from reaching the alert station 30. The alert station 30 may wait a predetermined period of time to receive the heartbeat signal after receiving the fall indication. In one example, the alert station 30 waits between about three-to-five seconds before declaring an emergency.

Figure 10:
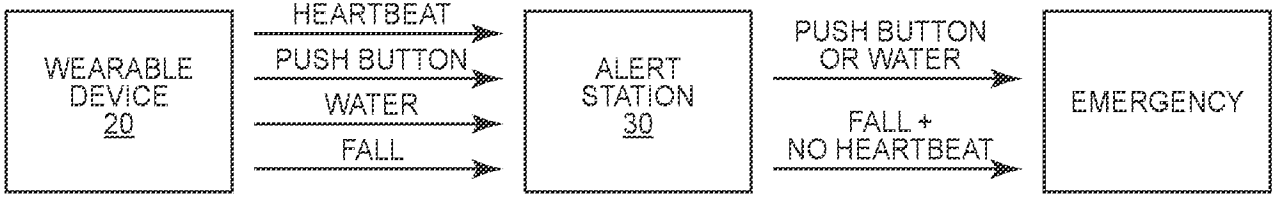
FIG. 10 is a schematic diagram of data flow between a wearable device and an alert station and the manner in which an emergency is declared.

FIG. 10 illustrates a schematic diagram of several manners in which an emergency is declared by the alert station 30. The alert station 30 periodically receives the heartbeat signal from the wearable device 20. In one example, the signal is received at a regular timing pattern (e.g., every 5 seconds, every 2 seconds). The signal can simply indicate that the presence of the wearable device 20 within the range of the alert station 30. The signal can also provide information to the alert station 30, such as a remaining life of the power source 53 and a strength of the signal.

The alert station 30 is further configured to receive other indications from the wearable device 20, including activation of the input button 26, indication of water, and indication of a fall. The alert station 30 declares an emergency upon receiving the activation of the input button 26 or the indication of water. The alert station 30 also declares an emergency when receiving the indication of a fall and no heartbeat signal within a predetermined period of time receiving the indication of the fall.

In one example, the control circuit 21 is configured to receive the raw sensor data and determine when a fall has occurred and that the wearable device 20 is in water. The control circuit 21 then causes this determination to be signaled to the alert station 30. In another example, the raw data is transmitted to the control circuit 31 of the alert station 30 that determines whether a fall has occurred or the wearable device 20 is in the water. In another example, this processing is split between the two components. In yet another example, both components perform this processing.

At the occurrence of the detected emergency, the wearable device 20 signals to the alert station 30. The wearable device 20 and alert station 30 are configured to communicate in a variety of environments, such through LoRa when the wearable device 20 (and wearer) are submersed in water. This provides for the signal to be more effectively transmitted and received between the device 20 and station 30 than in other frequency bands.

Figure 11:
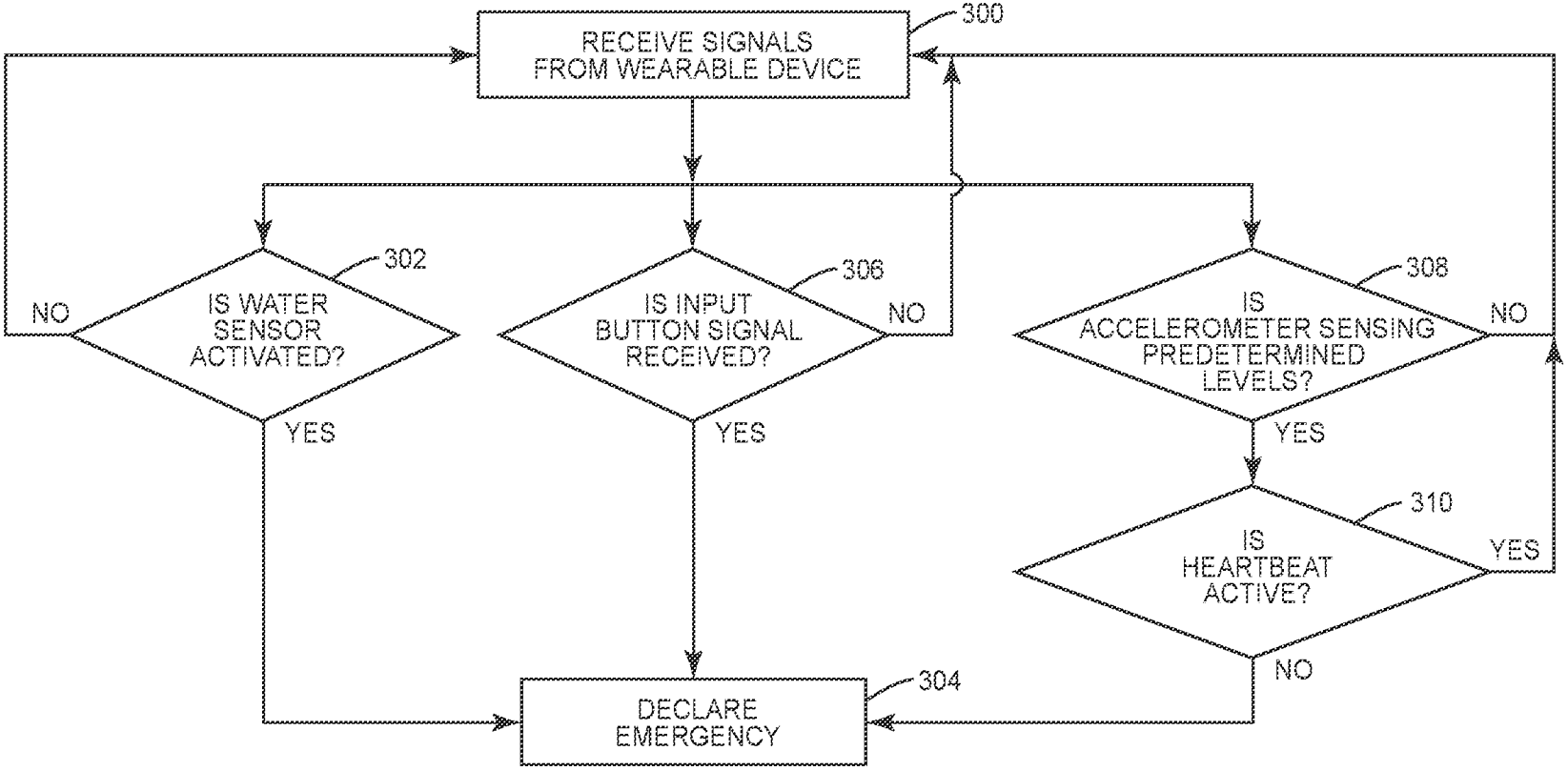
FIG. 11 is a flowchart diagram of a method of declaring an emergency.

FIG. 11 illustrates a method of the alert station 30 declaring an emergency. The alert station 30 monitors the wearable device 20 and receives periodical signals from the wearable device 20 (block 300). The alert station 30 determines an emergency upon determining any of the following situations. If the alert station 30 determines that one or more of the water sensors 55 is in water (block 302), the alert station declares an emergency (block 304). If the alert station 30 determines that the input button 26 has been depressed on the wearable device (block 306), an emergency is declared (block 304). If the alert station 30 determines that the user has fallen (block 308) and a heartbeat signal is not received within a predetermined time from when the user has fallen (block 310), an emergency is declared (block 304). In the various situations, the determination of the wearer based on the one or more sensor 55 readings can be determined by one or both of the control circuits 21, 31.

When the alert station 30 declares an emergency, the alert station 30 will activate in the following ways: 1) audible alarm through the speaker 37 which can be customized by the user, 2) visual alarm on the display 34, such as red lights, and 3) signaling the remote server 60 to inform PunchAlert cloud software stored in memory circuit 62 at the server 60 of the emergency, the nature of the emergency (water, fall or button activation), location and ID of the alert station 30, and any other relevant information. This final connection to PunchAlert allows the server 60 to then remotely notify relevant people including internal responders and potentially official responders such as emergency personnel 70 that are not in close proximity to see or hear the alert station 30. The alert station 30 will display and play the alarm for predesignated amount of time configured in the rescue software stored in the memory circuit 32 or stop earlier if it is deactivated either by a long-press of an input button 26 on the wearable device 20 or a press of a reset input 35 on the alert station 30. When deactivated, the alert station 30 will inform the server 60 that the emergency has been locally deactivated, and then responders can manually resolve the emergency. There may be a setting such that when the emergency is locally deactivated (by the wearable device 20 or alert station 30) that the emergency in the software be automatically be deactivated as well.

The alert station 30 can also be configured to perform additional functionality. 1) The microphone 38 and audio processing circuit 39 can provide for 911+ calling from the alert station 30. By including the microphone 38 and audio processing circuit 39, the user can access PunchAlert 911+ Connect service to enable data-based (internet-based) 911 calling at the time of an emergency where the 911 call itself would be carried on through the alert station 30 itself. 2) Video streaming and recording. The alert station 30 can include a video camera and associated processing circuits to provide for transmitting a live stream (and a recording afterwards) of the emergency to responders. The responders may be able to use the PunchAlert mobile application or web-console to view what is happening at the location of the activation. This immediate evidence and timely recording will be of great use in assessing the seriousness of the situation and who would be required for a response.

The system 10 can include software that is maintained at one or more of the alert station 30, remote server 60, or wearable device 20 to provide for various functionality. A rescue software module allows for customization of various components of the rescue system 10. For example, this can include the following: 1) Naming of one or more of the devices 20, 30; 2) Determining the location of each device 20, 30; 3) Audible alarm types and setup for each alert station 30; 4) Visual alarm choosing for each alert station 30; 5) Set timers for various functions including length of visual and audible alarm, length of "test" time after removal from the Charging Station, etc.; 6) Other configurations including WIFI information for Charging Stations connected by WIFI; 7) Alerts section for information about the system including time a wearable device 20 was charged or taken off the charger, times it was tested, times it was activated, etc.; 8) A schedule of who would be "wearing" (or otherwise holding or nearby) each wearable device 20 at each time of day, for each day of the week and month. Other settings include how the Rescue system interfaces with the PunchAlert broader software including the formatting of any SMS or email messages sent out, the nature of how to resolve PunchAlert emergencies prompted from Rescue, and more.

The system 10 can also include software that provides for pulling other emergencies from the PunchAlert system that may not have been reported from a wearable device 20. For example, an organization may choose to use one or more of the alert stations 30 to notify people of a fire or lockdown that was initially reported using the PunchAlert mobile application. This connecting could allow the alert stations 30 to be deployed in an environment where the wearable devices 20 (and therefore charging stations 90 as well) would not be required. Of course, a hybrid environment is also foreseeable.

Figure 12:
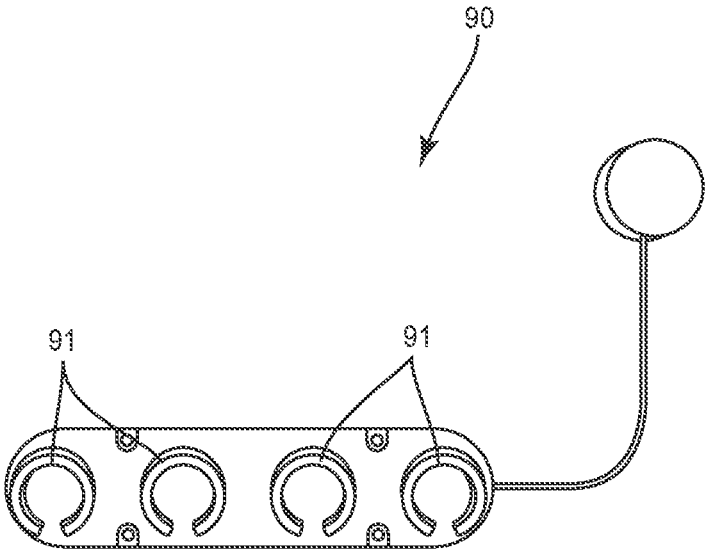
FIG. 12 is a perspective view of a charging station.

As illustrated in FIG. 12, a charging station 90 provides for charging one or more of the wearable devices 20. The charging station 90 includes receptacles 91 each sized to receive one of the wearable device 20. The wearable devices 20 can be equipped with a rechargeable power source 53 that requires period charging to ensure proper functioning. The charging station 80 can be placed on a table or installed on a wall for vertical wall-mounted charging. The wearable devices 20 can charge inductively (wirelessly) and a light illuminates on either or both of the wearable device 20 and charging station 90 when it is successfully in the act of charging.

The charging station 90 can also be used to prompt a "test" mode whereby when a wearable device 20 is removed from the charging station 90 for a specified period of time that any activations by water, orientation, or button 26 press will be in test mode. Activations by the wearable device 20 in test mode will likely not make a large audible noise or activate a declared emergency, but it can provide a visual cue to and from the alert station 30 that indicates the wearable device 20 is working and connected properly. Test mode alerts may also prompt a notification to the software in one or both of the memory circuits 22, 32 that the wearable device 20 has been tested, including a time stamp, device ID, how it was tested (by water or button press), and other relevant information. An audible or visual light on the wearable device 20 and/or the charging station 90 and/or the alert station 30 will indicate when test mode has expired, and that the wearable device 20 is ready for full usage.

In one example, the wearable device 20 communicates to the alert station 30 using infrared lights which are effective in water.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive.

What is claimed is:

1. A system to monitor a user at a water environment to determine when the user enters the water, the system comprising:

a wearable device configured to be worn by the user, the wearable device comprising:
- an input button;
- a first sensor that detects water; and
- a second sensor that detects one or more characteristics of a fall;

an alert station configured to receive signals from the wearable device, the alert station configured to declare an emergency in each of the following situations:
- the alert station receives a signal from the wearable device that the input button has been activated;
- the alert station receives a first signal from the wearable device that the first sensor detects the water;
- the alert station determines the user has fallen into the water based on a second signal received from the wearable device that the second sensor has detected one or more characteristics of a fall and the alert station does not receive a heartbeat signal from the wearable device or less than a predetermined number of the heartbeat signals within a predetermined period of time after receiving the second signal;

wherein the wearable device transmits the first signal upon initially detecting the water and the second signal immediately upon the second sensor detecting the one or more characteristics of a fall;

wherein the wearable device increases a frequency of the heartbeat signals that are transmitted to the alert station after the second sensor detects one or more characteristics of a fall.

2. The system of claim 1, wherein the wearable device comprises an exterior housing that extends around the second sensor and with the input button being exposed on the exterior housing.

3. The system of claim 1, wherein the alert station comprises a speaker to emit sound when an emergency is declared.

4. The system of claim 1, wherein the wearable device is configured to transmit the heartbeat signals to the alert station at regular time intervals.

5. The system of claim 1, wherein the wearable device is configured to transmit the signals to the alert station using LoRa signals.

6. The system of claim 1, wherein the alert station is configured to determine that there is no emergency upon receiving the heartbeat signal within the predetermined period of time after receiving the second signal from the wearable device.

7. The system of claim 1, wherein the wearable device is a first wearable device and further comprising a second wearable device that comprises an input button, a first sensor to detect that the wearable device is in the water, and a second sensor that detects that the user has fallen.

8. The system of claim 1, wherein the wearable device further comprises a control circuit configured to determine that the wearable device is in water based on readings from the first sensor and configured to determine that the user has fallen based on readings from the second sensor.

9. The system of claim 1, wherein the alert station further comprises a control circuit configured to determine that the wearable device is in water based on readings from the first sensor and configured to determine that the user has fallen based on readings from the second sensor.

10. A system to monitor a user at a water environment to determine when the user enters the water, the system comprising:

a wearable device configured to be worn by the user, the wearable device comprising:

a housing that extends around and forms an interior space;

an accelerometer positioned in the interior space;

a water sensor attached to the housing;

a wearable device control circuit positioned in the interior space; and a wearable device communication circuit configured to transmit signals;

an alert station configured to be positioned in proximity to the water environment, the alert station comprising:

a communications circuit configured to receive the signals from the wearable device;

an alert station control circuit configured to declare an emergency that the user is in danger in each of the following situations:

the user is in the water based on signals received from the wearable device indicating that the water sensor detects the water;

the user has fallen based on signals received from the wearable device indicating that the accelerometer has detected a fall and that a heartbeat signal has not been received or a limited number of the heartbeat signals have been received from the wearable device within a predetermined period of time after receiving the signals indicating the fall;

wherein the wearable device immediately transmits the signal to the alert station when the accelerometer detects a fall;

wherein the wearable device increases a frequency of the heartbeat signals that are transmitted to the alert station after the second sensor detects one or more characteristics of a fall.

11. The system of claim 10, further comprising a wearable device control circuit positioned in the interior space and configured to determine that the user has fallen based on signals from the accelerometer and to determine that the user is in the water based on signals from the water sensor.

12. The system of claim 10, wherein the alert station control circuit is configured to determine that the user has fallen based on a signal from the accelerometer and to determine that the user is in the water based on signals from the water sensor.

13. The system of claim 10, wherein the communications circuit of the wearable device is configured to transmit signals to the alert station using LoRa signals.

14. The system of claim 10, further comprising an input button on the housing and wherein the alert station control circuit is configured to declare an emergency that the user is in danger upon receiving a signal from the wearable device that the input button has been activated.

15. A method of monitoring a user that is wearing a wearable device around water to determine when the user enters the water, the method comprising:

receiving heartbeat signals at regular intervals from the wearable device indicating that the wearable device is within range;

receiving a first signal from the wearable device indicating that the user has activated an input button;

receiving a second signal from the wearable device indicating that the wearable device has initially detected the water;

receiving a third signal from the wearable device indicating that the user has fallen with the third signal sent from the wearable device immediately after detecting that the user has fallen;

after receiving the third signal indicating that the user has fallen, receiving the heartbeat signals at an increased frequency; and declaring an emergency for each of first, second, and third situations with the first situation comprising receiving the first signal, the second situation comprising receiving the second signal, and the third situation comprising receiving the third signal and not receiving a heartbeat signal or receiving a limited number of the heartbeat signals within a predetermined time after receiving the third signal.

16. The method of claim 15, further comprising receiving each of the heartbeat signals, the first signal, the second signal, and the third signal within a LoRa frequency range.

* * * * *